US006292072B1

(12) United States Patent
Bode et al.

(10) Patent No.: US 6,292,072 B1
(45) Date of Patent: Sep. 18, 2001

(54) RADIATING COAXIAL CABLE HAVING GROUPS OF SPACED APERTURES FOR GENERATING A SURFACE WAVE AT A LOW FREQUENCIES AND A COMBINATION OF SURFACE AND RADIATED WAVES AT HIGHER FREQUENCIES

(75) Inventors: Udo H. Bode, Branford; Anthony R. Fedor, Monroe, both of CT (US)

(73) Assignee: Times Microwave Systems, Division of Smith Industries Aerospace and Defense Systems, Inc., Wallingford, CT (US)

( * ) Notice: Subject to any disclaimer, the term of this patent is extended or adjusted under 35 U.S.C. 154(b) by 0 days.

(21) Appl. No.: 09/207,870

(22) Filed: Dec. 8, 1998

(51) Int. Cl.[7] ..... H01Q 13/20
(52) U.S. Cl. ..... 333/237; 343/770
(58) Field of Search ..... 333/237; 343/770

(56) References Cited

U.S. PATENT DOCUMENTS

| | | | | |
|---|---|---|---|---|
| 2,756,421 | * | 7/1956 | Harvey et al. | 343/770 |
| 3,691,488 | | 9/1972 | Holtum, Jr. | 333/237 |
| 4,322,699 | * | 3/1982 | Hildebrand et al. | 333/237 |
| 4,325,039 | * | 4/1982 | Allebone | 333/237 |
| 4,366,457 | | 12/1982 | Bode et al. | 333/237 |
| 4,800,351 | | 1/1989 | Rampalli et al. | 333/237 |
| 5,276,413 | | 1/1994 | Schulze-Buxloh | 333/237 |
| 5,291,164 | | 3/1994 | Levisse | 333/237 |
| 5,339,058 | | 8/1994 | Lique | 333/237 |
| 5,422,614 | | 6/1995 | Rampalli et al. | 333/237 |
| 5,467,066 | * | 11/1995 | Schulze-Buxloh | 343/770 X |
| 5,705,967 | * | 1/1998 | Pirard | 333/237 |

FOREIGN PATENT DOCUMENTS 3004882 10/1989 (DE) .

* cited by examiner

*Primary Examiner*—Benny Lee
(74) *Attorney, Agent, or Firm*—McCormick, Paulding & Huber LLP

(57) ABSTRACT

A radiating coaxial cable includes an inner conductor, an electrical insulator located about a periphery of the inner conductor, and an outer conductor located about a periphery of the electrical insulator. The outer conductor defines groups of apertures spaced from each other a predetermined distance in the range of from about twice the longest operational wavelength of the cable to less than ten meters. The aperture groups are designed in such a way to excite a surface wave at low operating frequencies and a combination of surface and radiating waves at high operational frequencies.

34 Claims, 2 Drawing Sheets

RADIATING COAXIAL CABLE HAVING GROUPS OF SPACED APERTURES FOR GENERATING A SURFACE WAVE AT A LOW FREQUENCIES AND A COMBINATION OF SURFACE AND RADIATED WAVES AT HIGHER FREQUENCIES

FIELD OF THE INVENTION

The present invention relates generally to a radiating coaxial cable, and more particularly to a radiating coaxial cable having groups of spaced apertures for generating a surface wave at low frequencies and a combination of surface and radiated waves at higher frequencies.

BACKGROUND OF THE INVENTION

Radiating and leaky coaxial cables are employed as longitudinal antennas in confined spaces like tunnels, mines, buildings and in other stretched-out applications involving a narrow lateral corridor needed for one or two way communication, such as railroads and highways.

Leaky coaxial cables support surface waves. The coupling loss between cable and antenna increases proportionally as $1/r^2$, where r is the distance between the cable and the antenna. The coupling loss also increases with increasing frequency. Leaky coaxial cables are known to employ, for example, outer conductors defining equally spaced groups of apertures, longitudinal apertures, corrugated outer conductors having milled-off corrugation tops, loosely braided outer conductors. Such prior art leaky coaxial cable designs are typically broad-banded.

Radiating coaxial cables radiate a free space wave. The coupling loss increases with 1/r, and is fairly constant over a relatively narrow design bandwidth. Prior art radiating coaxial cables are known to employ groups of apertures defined in the outer conductor. About half of the apertures within a group are tilted forward, the other half backward. The spaced groups of apertures must be designed about the center operational wavelength and to be configured for the specific bandwidth requirement.

U.S. Pat. No. 4,366,457 and corresponding German Pat. DE 30 04 882 C2 employ groups of coupling apertures which are so designed as to primarily support surface waves in comparison with radiating waves. The spacing between adjacent groups of coupling apertures is substantially larger than the operational wavelength, and more specifically is larger than 10 meters.

U.S. Pat. No. 5,276,413 describes a coaxial cable defining equally-spaced groups of apertures which excite a surface wave. There is one aperture per group in the first section at the cable input. The number of apertures within a group progressively increases with each subsequent cable section in order to maintain the coupling loss to be approximately constant along the length of the cable while the internal insertion loss increases. The group spacing must be smaller than half the smallest operational wavelength to avoid resonance return loss spikes within the operational frequency band. The number of apertures per cable length is therefore high, thus increasing the insertion loss and increasing the potential of moisture migrating through the apertures and into the cable.

U.S. Pat. No. 5,291,164 shows a coaxial cable which radiates a free space wave within the operational frequency band. The cable provides groups of apertures designed with respect to the center operational frequency. This design generates a surface wave below the radiating operational frequency band, but a high coupling loss limits its use at those frequencies. The bandwidth of the radiating operational frequency band is relatively narrow.

OBJECTS OF THE INVENTION

In response to the foregoing, an object of the present invention is to provide a radiating coaxial cable having groups of spaced apertures for generating a surface wave at low frequencies and a combination of surface and radiated waves at higher frequencies.

Another object of the present invention is to provide a radiating coaxial cable exhibiting low coupling loss over a wide frequency band.

A further object of the present invention is to provide a radiating coaxial cable which minimizes the number of apertures defined in its outer conductor in order to minimize the potential of water migrating into the inside of the cable and to obtain a low insertion loss for internal TEM waves propagating therethrough.

SUMMARY OF THE INVENTION

According to a first aspect of the present invention, a radiating coaxial cable includes an inner conductor, an electrical insulator located about a periphery of the inner conductor, and an outer conductor located about a periphery of the electrical insulator. The outer conductor defines groups of apertures spaced from each other a respective predetermined distance in the range from about eight meters to less than ten meters. The spacing is varied for return loss reasons.

According to a second aspect of the present invention, a radiating coaxial cable having a longitudinally extending center axis includes an inner conductor, an electrical insulator located about a periphery of the inner conductor, and an outer conductor located about a periphery of the electrical insulator. The outer conductor defines groups of apertures spaced from each other a predetermined distance in the range from about eight meters to less than ten meters. Each aperture includes at least one opening extending circumaxially of the center axis about a portion of the outer conductor. A respective height of each aperture in a direction along a circumference of the outer conductor is about 20% to about 40% of the circumference of the outer conductor. A respective width of each aperture in a direction along a length of the outer conductor is in a range from about half to less than a respective height of the aperture, and a spacing of at least a first and last aperture within an aperture group has a half wavelength resonance in a range from within to slightly above an operational frequency band of the cable, whereby a surface wave is generated at low frequencies and a combination of surface and radiated waves is generated at higher frequencies.

An advantage of the present invention is that the radiating coaxial cable exhibits low coupling loss over a wide frequency band.

Another advantage of the present invention is that the radiating coaxial cable minimizes the number of apertures defined in its outer conductor in order to minimize the potential of water migrating into the inside of the cable and to obtain an acceptable insertion loss for internal TEM waves.

DETAILED DESCRIPTION OF THE PREFERRED EMBODIMENTS

Radio frequency (RF) and microwave frequency electromagnetic waves are transmitted through a coaxial cable in the form of a transverse electromagnetic (TEM) wave. Groups of openings in the outer conductor are used to transfer energy to the outside of the cable. This energy forms mainly a surface wave (Goubau wave) for low operational frequencies (i.e., RF frequencies) and a combination of surface wave and radiated wave for high operational frequencies (i.e., microwave frequencies). The combination of surface wave and radiated wave at high operational frequencies substantially lowers the coupling loss, and does not limit the operational frequency bandwidth of the radiated coaxial cable.

Figure 1:
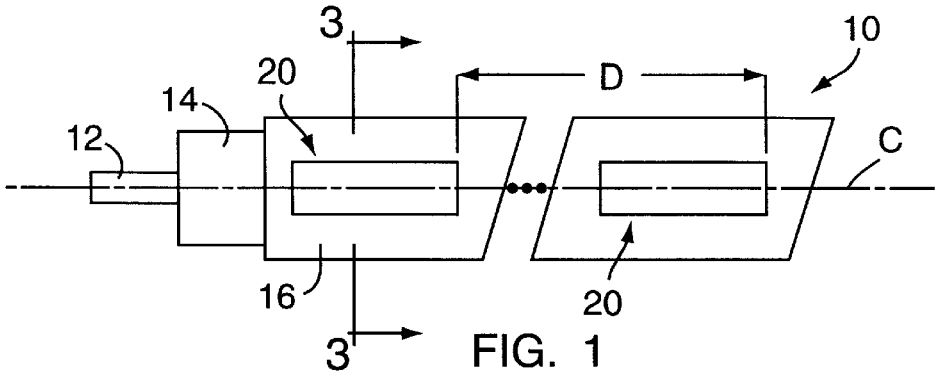
FIG. 1 schematically illustrates a side view of the cable without its outer jacket and showing groups of spaced apertures defined in its outer conductor.

With reference to FIGS. 1–5, a leaky/radiating coaxial cable embodying the present invention is generally designated by the reference number 10 (FIG. 1). For simplicity of illustration, the outer protective jacket of the coaxial cable 10 is not shown. The coaxial cable 10 comprises a solid or hollow inner conductor 12 (FIGS. 1, 3 and 4), an electrical insulator or dielectric 14 (FIGS. 1, 3 and 4) extending circumferentially about the inner conductor 12, and a cylindrically-shaped outer conductor 16 (FIGS. 1–4) having an inner surface 18 (FIGS. 3 and 4) opposing and extending circumferentially about the dielectric 14. The inner conductor 12 may be made of any material having good electrical conductivity such as copper, and may, for example, be in the form of solid wire, braided wire or a tube. The outer conductor 16 is preferably in the form of welded or overlapping copper or aluminum tape. The dielectric 14 is preferably polyethylene, polypropylene or Teflon®, and may be solid, foam or in the form of spacers in an air dielectric cable. A dielectric spacer may be made a solid dielectric, and may be embodied as individual spacers or helical spacers.

Figure 2:
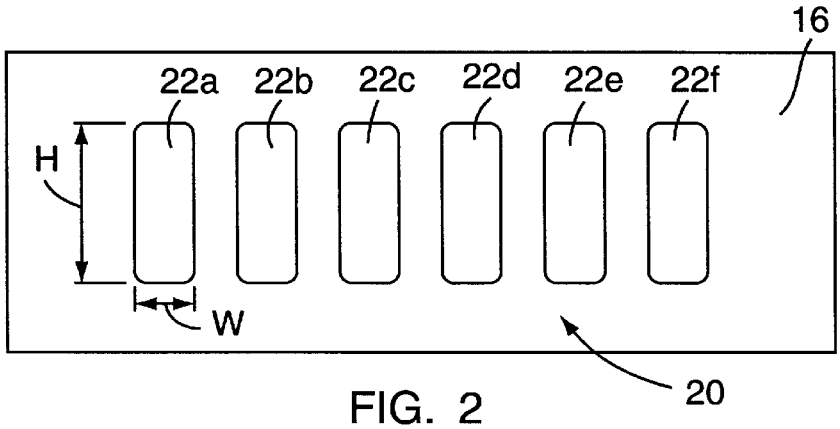
FIG. 2 illustrates a group of apertures in accordance with the present invention.
Figure 3:
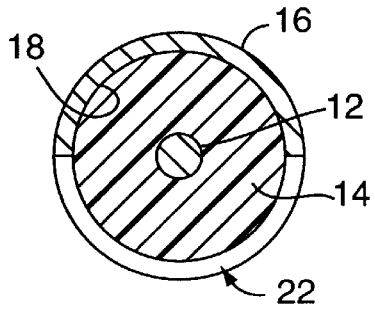
FIG. 3 is a cross-sectional view of the coaxial cable of FIG. 1 taken along lines 3—3 showing a single aperture configuration around the periphery of the cable in accordance with the present invention.
Figure 4:
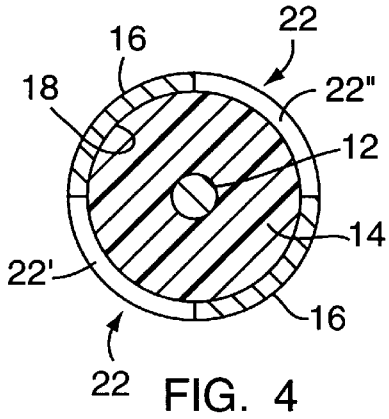
FIG. 4 is a cross-sectional view of the coaxial cable of FIG. 1 taken along the lines 3—3 showing a double aperture configuration around the periphery of the cable in accordance with the present invention.
Figure 5A:
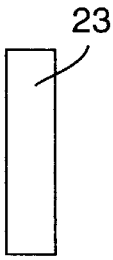
FIG. 5*a* illustrates a rectangular aperture in accordance with the present invention.
Figure 5B:
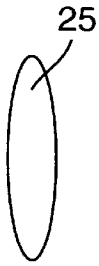
FIG. 5*b* illustrates an oval aperture in accordance with the present invention.
Figure 5C:
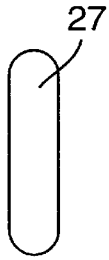
FIG. 5*c* illustrates a rectangular aperture with full radii corners in accordance with the present invention.
Figure 5D:
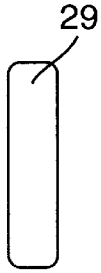
FIG. 5*d* illustrates a rectangular aperture with small radii corners in accordance with the present invention.

As shown in FIG. 1, the outer conductor defines groups of apertures 20 spaced longitudinally from each other a variable distance D within a predetermined range along the length of the coaxial cable 10. For simplicity of illustration, each group of apertures 20 in FIG. 1 is represented by a rectangle. Each group of apertures 20 includes a plurality of apertures. As shown in FIG. 2, for example, a group of apertures 20 defined in the outer conductor 16 (see FIG. 1) include six apertures 22*a*, 22*b*, 22*c*, 22*d*, 22*e* and 22*f* wherein each aperture is in the shape of a rectangle with rounded corners. The apertures 22, may have a variety of alternative shapes. For example, FIG. 5*a*–5*d* illustrate a rectangular aperture 23 having square corners (FIG. 5*a*), an oval aperture 25 (FIG. 5*b*), a rectangular aperture 27 having full radii corners (FIG. 5*c*), and a rectangular aperture 29 having small radii corners (FIG. 5*d*). Moreover, the apertures may extend at an oblique angle (not shown) relative to a center axis C extending along the longitudinal center of the coaxial cable 10. Each aperture also may be defined by one or a plurality of openings extending circumferentially about the periphery of the coaxial cable 10. As shown in FIG. 3, for example, an aperture 22 defined in the outer conductor 16 of the coaxial cable 10 defines a single opening extending circumferentially about a portion of the periphery of the cable. Alternatively, as shown in FIG. 4, each aperture 22 defined in the outer conductor 16 is comprised of two openings 22' and 22" each extending circumferentially about a portion of the periphery of the coaxial cable 10. The groups of apertures 20 defined in the outer conductor 16 act as feed points to facilitate energy transfer from an internal (TEM) wave to the outside of the coaxial cable 10 as a leaky (Goubau) wave at lower operational frequencies and as a combination of surface wave and radiated wave at higher operational frequencies.

More specifically, it has been discovered that a properly designed group of apertures generates a surface wave at low frequencies and a combination of surface and radiating waves at high frequencies. Preferably, the apertures are of rectangular shape with rounded corners or a full radius. The height "H" of the apertures defined as the length of the apertures in the direction along the circumference of the outer conductor 16 is from about 20% to about 40% of the circumference of the outer conductor 16. If two or more openings comprising an aperture are distributed about the circumference of the outer conductor 16, as shown in FIG. 4, the sum of the heights of the openings about the circumference is from about 20% to about 40% of the circumference of the outer conductor. The width W of the apertures defined as the length of the apertures in the direction along the length of the outer conductor 16 is about half or less than the aperture height H or combined height H if two or more openings comprising an aperture are distributed about the circumference of the outer conductor in FIG. 2. The spacing of the apertures within a group is determined by the operational frequency band of the cable. As shown in FIG. 2, at least the first aperture 22*a* and the last aperture 22*f* within an aperture group are spaced from one another such that the half wavelength resonance falls within the operational frequency band of the cable, but not necessarily on an operational frequency. Moreover, the half wavelength resonance may be slightly above the operational frequency band. Additional aperture combinations such as between the first aperture 22*a* and the fifth aperture 22*e*, or between the second aperture 22*b* and the last aperture 22*f* may have this half wavelength resonance condition which result in an increase in the energy level of the radiated wave. The non resonant apertures increase the energy level of the surface wave.

The coupling loss initially decreases with progressively increasing operational frequencies and remains essentially constant at higher operational frequencies. The aperture configuration of a group can furthermore be either optimized for a trade off between the internal insertion loss and the coupling loss or tailored to specific customer requirements. A decrease of the coupling loss increases the internal insertion loss. The longitudinal spacing D (see FIG. 1) between adjacent groups of apertures 20 is chosen to be in the range of about twice the longest operational wavelength to less than 10 meters. The smallest spacing is chosen to be 8 meters for a lowest operational frequency of 75 MHz. The spacing D may be varied along the above-mentioned range in order to avoid the energy reflected by the aperture groups from adding-up in phase at the cable input.

A reason that the longitudinal spacing D of the groups of apertures 20 is chosen not to exceed 10 meters is because the external surface wave and the radiated wave may be severely attenuated by the surrounding environment, such as for example, concrete and steel used for tunnel and building constructions. A single group of apertures 20 per cable length is theoretically sufficient for a long distance in free space, but this situation never happens in a typical installation.

Figure 6A:
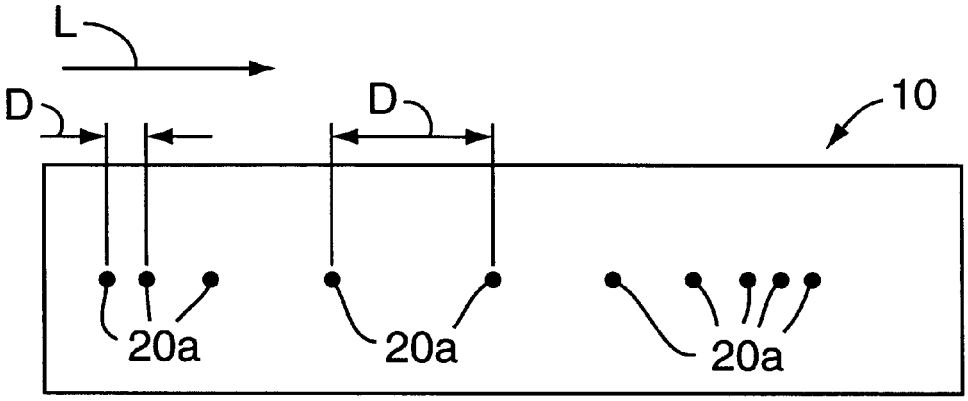
FIG. 6*a* schematically illustrates aperture group spacings which progressively increase and then progressively decrease along a length of the cable.
Figure 6B:
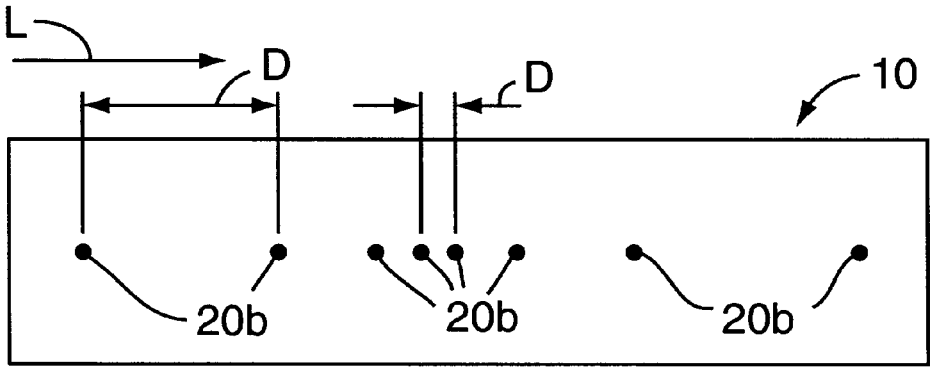
FIG. 6*b* schematically illustrates aperture group spacings which progressively decrease and then progressively increase along a length of the cable.
Figure 6C:
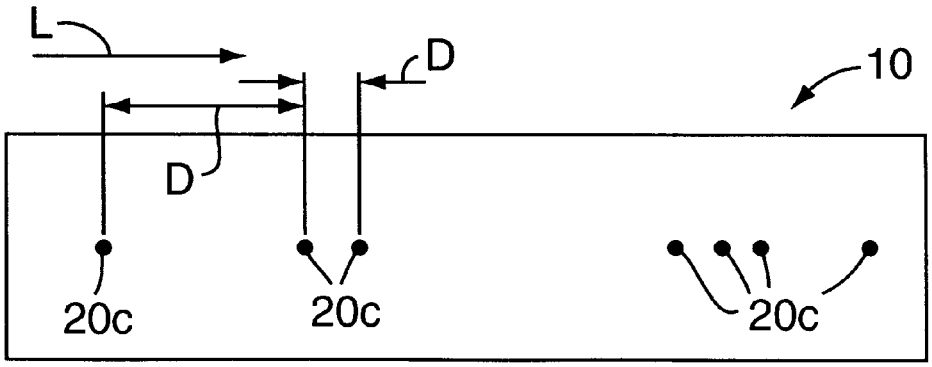
FIG. 6*c* schematically illustrates aperture group spacings which are randomized along a length of the cable.

Turning to FIGS. 6*a*, 6*b* and 6*c*, the distance D between adjacent groups of apertures should be varied along the length of the coaxial cable 10 to minimize their influence on the return loss. With reference to FIG. 6*a*, for example, the distance D between adjacent groups of apertures 20*a* (each aperture group schematically represented as a dot) along the length L of the coaxial cable 10 may progressively increase and then progressively decrease one or more times within the above-mentioned range of about eight to less than ten meters. With reference to FIG. 6*b*, the distance D between adjacent groups of apertures 20*b* along the length L of the cable may progressively decrease and then progressively increase one or more times within the above-mentioned range. Further, with reference to FIG. 6*c*, the distance D between adjacent groups of apertures 20*c* along the length of the coaxial cable 10 may be randomized within the above-mentioned range. Other suitable spacing patterns may also be employed for minimizing return loss.

The apertures distort the impedance of the internal coaxial system which carries the TEM wave. Reflections or distortions which are spaced from each other at half an operational wavelength and multiples thereof, add up in phase and result in high return loss spikes at the cable input. The relatively large group spacing D is beneficial in that the potential of moisture migrating into the internal coaxial system is less likely than with short coupling aperture spacing if the protective outer jacket of the coaxial cable should be damaged.

Although this invention has been shown and described with respect to an exemplary embodiments thereof, it should be understood by those skilled in the art that the foregoing and various other changes, omissions, and additions in the form and detail thereof may be made therein without departing from the spirit and scope of the invention.

What is claimed is:

1. A radiating coaxial cable comprising:

an inner conductor;

an electrical insulator located about a periphery of the inner conductor; and an outer conductor located about a periphery of the electrical insulator, the outer conductor defining groups of apertures, wherein apertures forming a group are axially spaced from one another within the group, and each group is axially spaced a predetermined distance from an adjacent group, the distance between adjacent groups being in the range from about eight meters to less than ten meters.

2. A radiating coaxial cable as defined in claim 1, wherein each of the groups of apertures includes at least two apertures.

3. A radiating coaxial cable as defined in claim 1, wherein each of the groups of apertures includes a plurality of apertures.

4. A radiating coaxial cable as defined in claim 1, wherein the apertures are rectangular in shape.

5. A radiating coaxial cable as defined in claim 1, wherein the apertures have a rectangular shape with rounded corners.

6. A radiating coaxial cable as defined in claim 1, wherein the apertures are oval in shape.

7. A radiating coaxial cable as defined in claim 1, wherein the cable has a longitudinally extending center axis, and wherein each aperture includes at least one opening extending circumaxially relative to the center axis about a portion of the outer conductor, and a respective height of each aperture in a direction along a circumference of the outer conductor being about 20% to about 40% of the circumference of the outer conductor.

8. A radiating coaxial cable as defined in claim 7, wherein each aperture includes two openings extending circumaxially about a portion of the outer conductor.

9. A radiating coaxial cable as defined in claim 7, wherein each aperture includes a plurality of openings extending circumaxially about a portion of the outer conductor.

10. A radiating coaxial cable as defined in claim 7, wherein the width of each aperture is about half the respective height.

11. A radiating coaxial cable as defined in claim 7, wherein the width of each aperture is less than the respective height.

12. A radiating coaxial cable as defined in claim 7, wherein a spacing of at least a first and last aperture within an aperture group has a half wavelength resonance within an operational frequency band of the cable.

13. A radiating coaxial cable as defined in claim 7, wherein a spacing of at least a first and last aperture within an aperture group has a half wavelength resonance slightly above an operational frequency band of the cable.

14. A radiating coaxial cable as defined in claim 1, wherein the respective distance between adjacent groups of apertures along an axial length of the cable progressively increases and then decreases within said range.

15. A radiating coaxial cable as defined in claim 1, wherein the respective distance between adjacent groups of apertures along an axial length of the cable progressively decreases and then increases within said range.

16. A radiating coaxial cable as defined in claim 1, wherein the respective distance between adjacent groups of apertures along an axial length of the cable varies randomly within said range.

17. A radiating coaxial cable having a longitudinally extending center axis, the cable comprising:

an inner conductor;

an electrical insulator located about a periphery of the inner conductor; and an outer conductor located about a periphery of the electrical insulator, the outer conductor defining groups of apertures, wherein apertures forming a group are axially spaced from one another within the group, and each group is axially spaced a predetermined distance from an adjacent group, the distance between adjacent groups being in the range from about eight meters to less than ten meters, each aperture including at least one opening extending circumaxially relative to the center axis about a portion of the outer conductor, a respective height of each aperture in a direction along a circumference of the outer conductor being about 20% to about 40% of the circumference of the outer conductor, and a respective width of each aperture being in a direction along a length of the outer conductor.

18. A radiating coaxial cable as defined in claim 7, wherein each of the groups of apertures includes a plurality of apertures.

19. A radiating coaxial cable as defined in claim 17, wherein the apertures are rectangular in shape.

20. A radiating coaxial cable as defined in claim 17, wherein the apertures have a rectangular shape with rounded corners.

21. A radiating coaxial cable as defined in claim 17, wherein the apertures are oval in shape.

22. A radiating coaxial cable as defined in claim 7, wherein each of the groups of apertures includes at least two apertures.

23. A radiating coaxial cable as defined in claim 17, wherein the respective distance between adjacent groups of apertures along an axial length of the cable progressively increases and then decreases within said range.

24. A radiating coaxial cable as defined in claim 17, wherein the respective distance between adjacent groups of apertures along an axial length of the cable progressively decreases and then increases within said range.

25. A radiating coaxial cable as defined in claim 17, wherein the respective distance between adjacent groups of apertures along an axial length of the cable varies randomly within said range.

26. A radiating coaxial cable as defined in claim 17, wherein each aperture includes two openings extending circumaxially about a portion of the outer conductor.

27. A radiating coaxial cable as defined in claim 17, wherein each aperture includes a plurality of openings extending circumaxially about a portion of the outer conductor.

28. A radiating coaxial cable as defined in claim 17, wherein a spacing of at least a first and last aperture within an aperture group has a half wavelength resonance slightly above an operational frequency band of the cable.

29. A radiating coaxial cable as defined in claim 17, wherein a spacing of at least a first and last aperture within an aperture group has a half wavelength resonance within an operational frequency band of the cable.

30. A radiating coaxial cable as defined in claim 17, wherein the width of each aperture is about half of the respective height.

31. A radiating coaxial cable as defined in claim 17, wherein the width of each aperture is less than the respective height.

32. A radiating coaxial cable comprising:

an inner conductor;

an electrical insulator located about a periphery of the inner conductor; and an outer conductor located about a periphery of the electrical insulator, the outer conductor defining groups of apertures, wherein apertures forming a group are axially spaced from one another within the group, and each group is axially spaced a predetermined distance from an adjacent group, the distance between adjacent groups being in the range from about eight meters to less than ten meters, and wherein the distance between adjacent groups of apertures along a length of the cable progressively decreases and then increases within said range.

33. A radiating coaxial cable comprising:

an inner conductor;

an electrical insulator located about a periphery of the inner conductor; and an outer conductor located about a periphery of the electrical insulator, the outer conductor defining groups of apertures, wherein apertures forming a group are axially spaced from one another within the group, and each group is axially spaced a predetermined distance from an adjacent group, the distance between adjacent groups being in the range from about eight meters to less than ten meters, and wherein the distance between adjacent groups of apertures along a length of the cable varies randomly within said range.

34. A radiating coaxial cable comprising:

an inner conductor;

an electrical insulator located about a periphery of the inner conductor; and an outer conductor located about a periphery of the electrical insulator, the outer conductor defining groups of apertures, wherein apertures forming a group are axially spaced from one another within the group, and each group is axially spaced a predetermined distance from an adjacent group, the distance between adjacent groups being in the range from about eight meters to less than ten meters, and wherein the distance between adjacent groups of apertures along a length of the cable progressively increases and then decreases within said range.

* * * * *